US005368053A

United States Patent [19]

Wilson

[11] Patent Number: 5,368,053

[45] Date of Patent: Nov. 29, 1994

[54] PARTS CLEANING MACHINE AND METHOD OF CLEANING PARTS

[75] Inventor: Karle M. Wilson, W. Chester, Ohio

[73] Assignee: Ransohoff Company, Hamilton, Ohio

[21] Appl. No.: 737,423

[22] Filed: Jul. 29, 1991

[51] Int. Cl.[5] ..... B08B 3/04

[52] U.S. Cl. ..... 134/95.2; 134/95.3; 134/98.1; 134/135; 134/153; 134/157; 134/188

[58] Field of Search ..... 134/153, 135, 200, 147, 134/157, 95.1, 103.1, 95.2, 98.1, 195, 188; 99/516, 536; 68/207, 210; 422/301

[56] References Cited

U.S. PATENT DOCUMENTS

| | | | |
|---|---|---|---|
| 294,346 | 3/1884 | Atkins | 134/135 |
| 542,438 | 7/1895 | Butler | 134/135 |
| 1,128,722 | 2/1915 | Renisch | 134/157 |
| 1,183,493 | 5/1916 | Randolph | 134/135 |
| 1,416,402 | 5/1922 | Dye | 134/135 |
| 1,470,586 | 10/1923 | Sherman | 134/135 |
| 1,767,858 | 6/1930 | Shultz | 134/145 |
| 2,571,032 | 10/1951 | Hanson | 134/157 X |
| 3,054,411 | 9/1962 | Randall | 134/111 |
| 3,645,791 | 2/1972 | Sadwith | 134/25 A |
| 3,916,937 | 11/1975 | Nystrom | 134/99.1 |
| 3,945,388 | 3/1976 | Clark | 134/103.1 |
| 4,117,855 | 10/1978 | Olcott et al. | 134/141 |
| 4,126,148 | 11/1978 | Norstrom | 134/164 |
| 4,129,138 | 12/1978 | Nystrom | 134/153 X |
| 4,143,669 | 3/1979 | Minkin | 134/153 |
| 4,165,994 | 8/1979 | Jackson | 134/104 |
| 4,236,541 | 12/1980 | Cipriani | 134/153 |
| 4,739,782 | 4/1988 | Nourie | 134/140 |
| 4,741,351 | 5/1988 | Minkin | 134/144 |
| 5,000,206 | 3/1991 | Kramer et al. | 134/148 |
| 5,015,302 | 5/1991 | Henig | 134/153 X |
| 5,063,949 | 11/1991 | Yates | 134/103.1 |

*Primary Examiner*—Frankie L. Stinson
*Attorney, Agent, or Firm*—Jack C. McGowan

[57] ABSTRACT

A machine for cleaning parts includes a reservoir and two tanks. Wash solution is contained in one of the tanks while rinse solution is contained in the other tank. Pumps transfer the wash solution and the rinse solution from the tanks to the reservoir. A pair of pivotally mounted arms rotatably support a basket for holding parts. The basket is movable between a loading position, a cleaning position and a draining position. When the basket is in the cleaning position inside the reservoir, it is alternately rotated in opposite directions to improve the cleaning efficiency of the machine.

6 Claims, 1 Drawing Sheet

PARTS CLEANING MACHINE AND METHOD OF CLEANING PARTS

FIELD OF THE INVENTION

This invention relates generally to a parts cleaning machine and a method of cleaning parts and, in particular, to a machine and a method for removing grease, oil, and other residue from machined parts and various articles of manufacture. More specifically, this invention relates to a machine and a method for cleaning intricate parts having internal bores and cavities.

BACKGROUND OF THE INVENTION

Parts washing machines such as disclosed in U.S. Pat. Nos. 3,645,791 to Sadwith and 4,143,669 to G. E. Minkin include a turntable and spray nozzles for directing cleaning solution at parts supported on the turntable. In the machine disclosed by Sadwith, the spray nozzles rotate, but in the machine disclosed by Minkin, the spray nozzles remain stationary. U.S. Pat. No. 3,054,411 to Randall discloses a parts cleaning machine having an oscillating basket and rotating spray nozzles. U.S. Pat. No. 4,165,994 to Jackson discloses a parts washing machine having a rotatable tub movable between a washing position, a drying position and an unloading position.

SUMMARY OF THE INVENTION

The present invention provides a parts cleaning machine comprised of a reservoir, a first tank containing wash solution, a second tank containing rinse solution, pumps for transferring wash solution and rinse solution from the first and second tanks to the reservoir, and a basket for holding parts. The basket is movable between a loading position outside the reservoir, a cleaning position inside the reservoir, and a draining position inside the reservoir. In the preferred embodiment of the present invention, the basket is alternately rotated in opposite directions when it is in the cleaning and draining positions. A first motor moves the basket between the loading, cleaning, and draining positions, and a second motor rotates the basket when it is in the cleaning and draining positions. A fan blows air at the basket when it is in the draining position.

The present invention also provides a method of cleaning parts comprising the steps of loading parts into the basket while it is in the loading position outside the reservoir, transferring wash solution from the first tank to the reservoir, moving the basket from the loading position to the cleaning position inside the reservoir, alternately rotating the basket in opposite directions in the wash solution while it is in the cleaning position, emptying the wash solution from the reservoir, transferring rinse solution from the second tank to the reservoir, continuing to alternately rotate the basket in opposite directions in the rinse solution while it remains in the cleaning position, emptying the rinse solution from the reservoir, moving the basket from the cleaning position to the draining position inside the reservoir, and moving the basket from the draining position to the loading position.

DESCRIPTION OF THE PREFERRED EMBODIMENT

Figure 1:
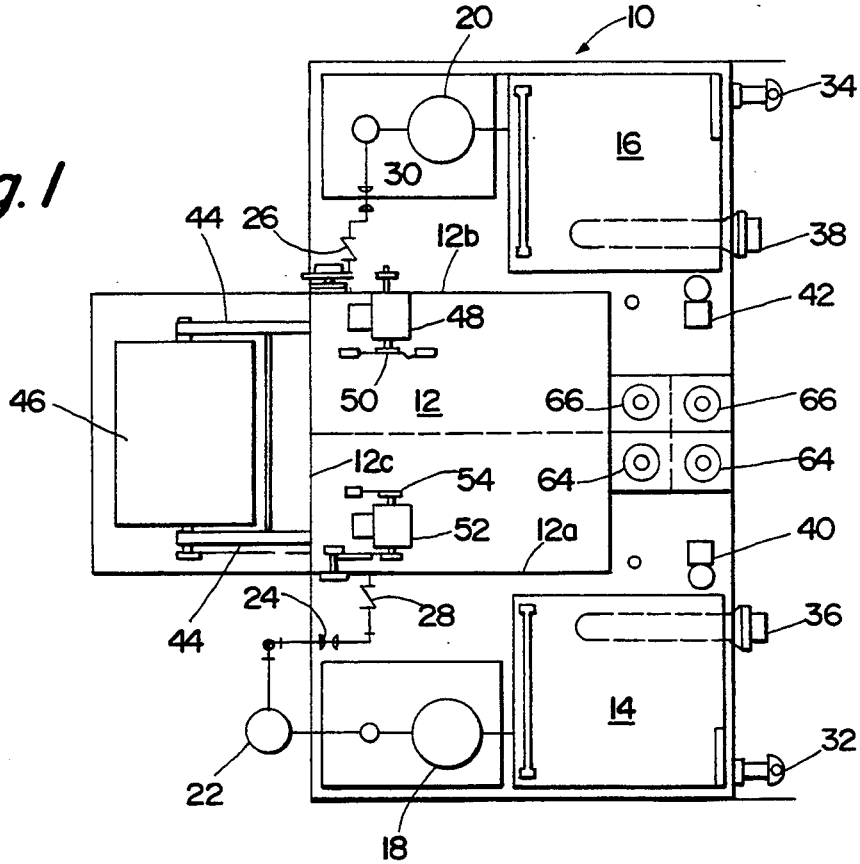
FIG. 1 is a top plan view of a parts cleaning machine according to the preferred embodiment of the present invention.
Figure 2:
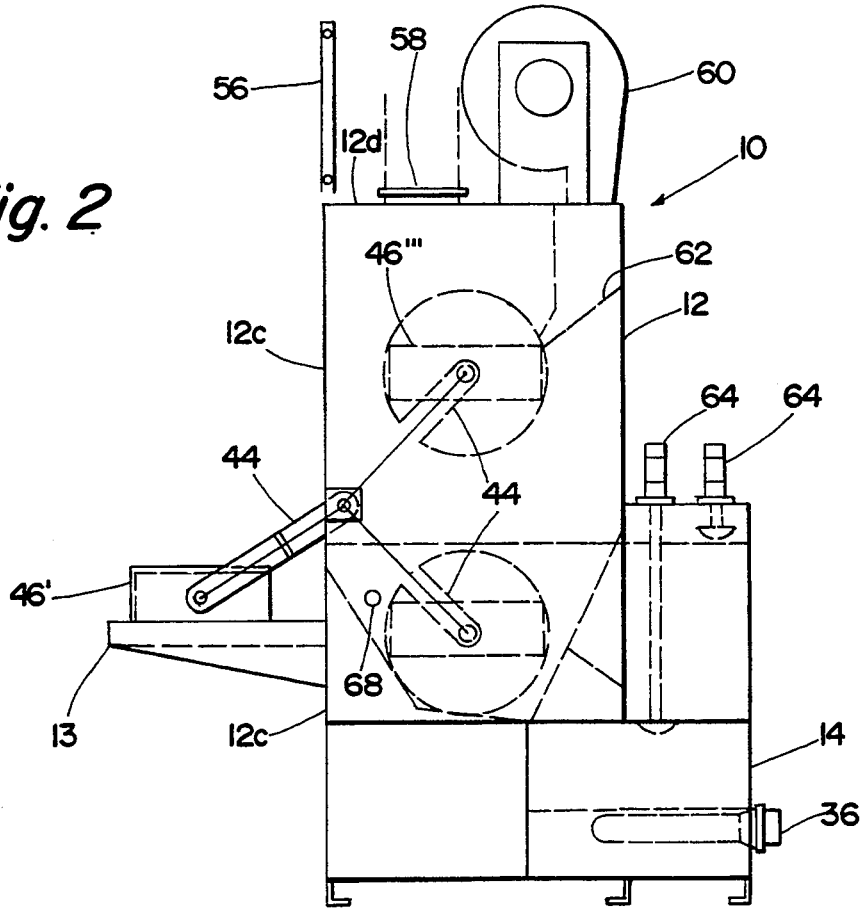
FIG. 2 is a side elevational view of the parts cleaning machine shown in FIG. 1.

Referring to FIGS. 1 and 2, a parts cleaning machine 10 includes a reservoir 12 and two tanks 14, 16. Wash solution is contained in tank 14 while rinse solution is contained in tank 16. Reservoir 12 is elevated with respect to the tanks 14 and 16. Pumps 18, 20 transfer the wash solution and the rinse solution from the tanks 14, 16 into the reservoir 12. The wash solution may be pumped through a filter 22, if desired. Ball valves 24, 26 and check valves 28, 30 control the transfer of wash solution and rinse solution from the tanks 14, 16 into the reservoir 12. The tanks 14, 16 have drain plugs 32, 34, optional heaters 36, 38 and float switches 40, 42.

A pair of arms 44 are pivotally mounted at their inner ends on side walls 12*a*, 12*b* of the reservoir 12 and rotatably support a basket 46 at their outer ends. When the basket 46 is in a loading position 46' outside the reservoir 12 as shown in FIG. 2, it rests on a shelf 13 which is attached to a front wall 12*c* of the reservoir 12. An alternating current motor 48 with a three position limit switch 50 is connected to the arms 44 to move the basket 46 between the loading position 46', a cleaning position 46'' inside the reservoir 12, and a draining position 46''' inside the reservoir 12 as shown in FIG. 2. A direct current motor 52 with a limit switch 54 is connected to rotate the basket 46 when it is in the cleaning and draining positions 46'' and 46'''. Motor 52 is bidirectional in order to rotate the basket 46 in opposite directions, i.e. clockwise and counterclockwise as viewed in FIG. 2. The basket 46 is preferably rotated at 3 to 12 rpm in both directions.

The reservoir 12 has a slidable door 56 that is air operated in its front wall 12*c*. A vent connection 58 is provided in a top wall 12*d* of the reservoir 12, and a fan 60 blows air into the reservoir 12 through a duct 62. Air cylinders 64, 66 are utilized to divert wash solution and rinse solution from the reservoir 12 into the tanks 14, 16.

The parts cleaning machine 10 operates in the following sequence. An operator pushes an enable button (not shown) activating the pump 18 which floods the reservoir 12 with wash solution from tank 14. Preferably, the wash solution enters the reservoir 12 through spray nozzles such as indicated at 68 in FIG. 2. The operator loads the basket 46 with parts for cleaning and pushes a cycle start button (not shown). The door 56 opens automatically and the motor 48 moves the basket 46 from the loading position 46' to the cleaning position 46''. After the door 56 closes, the motor 52 rotates the basket 46 clockwise as viewed in FIG. 2 for an interval of 30 seconds and then rotates the basket 46 counterclockwise for another interval of 30 seconds. The basket 46 is alternately rotated clockwise and counterclockwise in subsequent intervals of 30 seconds each during a wash cycle which lasts two minutes.

When the wash cycle ends, the pump 18 stops but the motor 52 continues to rotate the basket 46 clockwise for 15 seconds while the cylinders 64 divert the wash solution from the reservoir 12 to the tank 14. The pump 20 is turned on flooding the reservoir 12 with rinse solution from tank 16 as the motor 52 continues to rotate the basket 46 clockwise for another 60 seconds. During a rinse cycle that lasts one minute, the basket 46 is rotated clockwise for 30 seconds and then counterclockwise for another 30 seconds.

As the rinse cycle ends, the pump 20 is turned off and the basket 46 is moved by the motor 48 from the cleaning position 46'' to the draining position 46''' while the motor 52 continues to rotate the basket 46. Cylinders 66 divert the rinse solution from the reservoir 12 to the tank 16. The basket 46 is rotated counterclockwise for 15 seconds to allow draining. The fan 60 turns on, and the basket 46 is rotated counterclockwise for 30 seconds and then clockwise for 30 seconds. During a drying cycle that last two minutes, basket 46 is subsequently rotated counterclockwise for another 30 seconds and clockwise for a final 30 seconds while the fan 60 blows air at the basket 46 through the duct 62. As the drying cycle ends, the fan 60 turns off and the basket 46 stops rotating. The door 56 opens after a 10 second delay, and the basket 46 is moved from the draining position 46''' to the loading position 46' by the motor 48.

As the basket 46 is rotated in the reservoir 12 during the wash cycle, the spray nozzles 68 which are submerged direct wash solution at the parts in the basket 46 dislodging surface contaminants from the parts and reorienting the parts to allow the wash solution to enter cavities in the parts and remove any debris from internal recesses in the parts. When the spray nozzles 68 are submerged in the wash solution during the wash cycle, they produce severe agitation in the reservoir 12 thus giving optimum cleaning. Since the reservoir 12 is constantly overflowing during the wash cycle, any floating oils are removed from the reservoir 12 and thereby prevented from being redeposited onto the parts in the basket 46. The cleaning efficiency of the machine 10 is also improved by alternately rotating the basket 46 in opposite directions.

At the end of the wash cycle, the wash solution will be quickly emptied from the reservoir 12 and returned to the tank 14. This quick emptying of the reservoir 12 causes a violent high velocity torrent of fluid rushing out of the reservoir 12 which will remove most of the accumulated debris from the reservoir 12. The motor 52 will continue to rotate the basket 46 at the end of the wash cycle so that the spray nozzles 68 will assure the removal of any particulate that may have remained in the reservoir 12 or on the parts in the basket 46.

It will be understood that since the operating sequence described above takes 7.5 minutes, eight basket loads of parts may be cleaned in one hour by the machine 10.

What is claimed is:

1. A parts cleaning machine comprising:

a reservoir;

a first tank discrete from said reservoir for containing wash solution;

a second tank discrete from said reservoir and said first tank for containing rinse solution;

means for transferring wash solution and rinse solution from said first and second tanks to said reservoir;

a basket for holding parts, said basket being movable between a loading position outside said reservoir, a cleaning position inside said reservoir, and a draining position inside said reservoir;

a first means mounted to said reservoir for moving said basket between said loading, cleaning, and draining positions;

a second means for rotating said basket when it is in said cleaning and draining positions;

and a plurality of spray means mounted within said reservoir and located at a certain level therein for directing wash solution against said basket when it is in said cleaning position and rotating until the reservoir is filled to said level such that the spray means becomes submerged and then for producing severe agitation in said reservoir as said basket continues to rotate to dislodge surface contaminants from the parts and to allow the wash solution to enter and remove debris from internal recesses in said parts.

2. The parts cleaning machine of claim 1, further comprising a fan for blowing air at said basket when it is in said draining position.

3. The parts cleaning machine of claim 1, wherein said reservoir is elevated with respect to said first and second tanks.

4. The parts cleaning machine of claim 1, wherein said first means comprises a pair of pivotally mounted arms rotatably supporting said basket.

5. The parts cleaning machine of claim 1, further comprising valves for controlling the transfer of wash solution and rinse solution from said first, and second tanks to said reservoir.

6. The parts cleaning machine of claim 1, further comprising valves for rapidly draining the wash solution and rinse solution from said reservoir back to the appropriate tank.

* * * * *